US007163386B2

(12) United States Patent
Tsuchiya et al.

(10) Patent No.: US 7,163,386 B2
(45) Date of Patent: Jan. 16, 2007

(54) SCROLL COMPRESSOR HAVING A MOVABLE AUXILIARY PORTION WITH CONTACT PLANE OF A STOPPER PORTION TO CONTACT A PANE OF THE FIXED SCROLL THROUGH ELASTIC PRESSURE OF HIGH PRESSURE FLUID

(75) Inventors: Takeshi Tsuchiya, Tsuchiura (JP); Yuuichi Yanagase, Tamatsukuri (JP); Kazuyuki Fujimura, Chiyoda (JP); Makoto Aoki, Tomobe (JP); Shigekazu Nozawa, Shizuoka (JP); Mutsunori Matsunaga, Shizuoka (JP); Satoshi Nakamura, Shizuoka (JP); Masaru Ohtahara, Shizuoka (JP); Shuuji Hasegawa, Shizuoka (JP); Yoshinobu Yosuke, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 58 days.

(21) Appl. No.: 11/065,371

(22) Filed: Feb. 25, 2005

(65) Prior Publication Data

US 2005/0226755 A1 Oct. 13, 2005

(30) Foreign Application Priority Data

Apr. 12, 2004 (JP) ..... 2004-116586

(51) Int. Cl.
*F03C 2/00* (2006.01)
*F04C 18/00* (2006.01)

(52) U.S. Cl. ..... 418/55.5; 418/55.1; 418/55.3; 418/57; 464/102

(58) Field of Classification Search ..... 418/55.1–55.6, 418/57, 107; 464/102
See application file for complete search history.

(56) References Cited

U.S. PATENT DOCUMENTS 5,192,202 A * 3/1993 Lee ..... 418/55.5
5,263,822 A * 11/1993 Fujio ..... 418/55.5
6,168,404 B1 * 1/2001 Gatecliff ..... 418/55.5

FOREIGN PATENT DOCUMENTS

JP 1-177482 7/1989
JP 06173864 A * 6/1994
JP 07035062 A * 2/1995
JP 7-117049 12/1995
JP 08319960 A * 12/1996

* cited by examiner

*Primary Examiner*—Theresa Trieu
(74) *Attorney, Agent, or Firm*—Antonelli, Terry Stout and Kraus, LLP

(57) ABSTRACT

A scroll compressor has a movable auxiliary member provided by mounting it between a frame member and a circling scroll member. The movable auxiliary member has a stopper portion for causing a contact plane to contact a pane of a fixed scroll member and a ring portion having an opposed plane annularly formed to face the pane of the circling scroll member, is further supported elastically by an elastic support in a state of being energized in a direction of the circling scroll member, has the contact plane of the stopper portion caused to contact the pane in this elastic support state to keep a limit position with the opposed plane facing the pane of the circling scroll member, and goes back elastically to the frame member side when the circling scroll member goes back to the frame member side and the pane is pressed to contact the opposed plane.

6 Claims, 4 Drawing Sheets

SCROLL COMPRESSOR HAVING A MOVABLE AUXILIARY PORTION WITH CONTACT PLANE OF A STOPPER PORTION TO CONTACT A PANE OF THE FIXED SCROLL THROUGH ELASTIC PRESSURE OF HIGH PRESSURE FLUID

BACKGROUND OF THE INVENTION

The present invention relates to a compressor for compressing a fluid such as a refrigerant or air, and in particular to a scroll compressor for changing capacity of a compression space formed by a fixed scroll member and a circling scroll member by means of circling movement of the scroll member and thereby compressing the fluid.

PRIOR ART

A scroll compressor is widely used as a compressor for refrigeration and air-conditioning equipment for instance, because it has advantages over other compressors, such as being high-efficiency and high-reliability and being silent in addition. For this reason, plenty of research and development are underway as to the scroll compressor.

In general, the scroll compressor is airtightly covered in its entirety with a cylindrical airtight container having its top and bottom sealed off in which a fixed scroll member and a circling scroll member configuring a compression portion for compressing a fluid are provided. The fixed scroll member is formed in a structure having a spiral scroll lap erected on an end plate, and is fixed on a frame member fixedly provided inside the airtight container. The circling scroll member is formed in the structure having the spiral scroll lap erected on the end plate as with the fixed scroll member, and is provided between the frame member and the fixed scroll member to engage each of the scroll laps thereof with the fixed scroll member and form a compression space, and is also connected to driving means so as to allow circling movement. The driving means drives the circling scroll member in a whirl so as to change capacity of the compression space and compress the fluid.

As for such a scroll compressor, it is important, for the sake of improving compression efficiency of the fluid, to allow high airtightness to be kept as to the compression space formed by the respective scroll laps of the fixed scroll member and circling scroll member. For that reason, there is a generally used structure in which a high-pressure fluid generated in the compression space is used to elastically support the circling scroll member which is thereby pressed to contact the fixed scroll member side. It is then possible to adequately set a pressure of the high-pressure fluid exerted for elastic support so as to keep the airtightness sufficiently high. In the case of having only such an elastic pressurization support structure, however, the circling movement of the circling scroll member becomes unstable. There is a known structure, for that reason, in which a pane extended from the end plate of the circling scroll member is supported by a thrust bearing (Patent Document 1 for instance). There is another known structure in which an opposed plane is formed on the frame member, facing the pane of the circling scroll member with a minute clearance of 20 to 30μ for instance.

[Patent Document 1] JP-B-7-117049

The above-mentioned structure in which the opposed plane is facing the pane of the circling scroll member with a minute clearance, that is, an opposed plane setup structure is superior to the structure in which the pane of the circling scroll member is supported by the thrust bearing in that there is no driving force loss factor such as frictional resistance due to sliding contact between the thrust bearing and the pane. As regards the opposed plane setup structure, it is desirable, for the sake of further stabilizing the circling movement of the circling scroll member, to make the clearance between the opposed plane and the pane of the circling scroll member 10μ or less for instance or as small as possible to the extent that the opposed plane does not support the pane thrust bearing-wise but contacts it. On the other hand, however, it is conventionally necessary to provide a clearance of a certain size or larger in order to avoid a problem that the pane is pressed to the opposed plane of the frame member and galling occurs when the circling scroll member goes back to the frame member due to abnormal rise in compression space pressure or the like.

BRIEF SUMMARY OF THE INVENTION

The present invention has been implemented in consideration of such circumstances, and an object thereof is to realize the opposed plane setup structure for the scroll compressor capable of, even when setting a smaller clearance, effectively avoiding occurrence of the galling when the circling scroll member goes back. Another object is to realize such an opposed plane setup structure without changing a basic design of an existing scroll compressor.

For the sake of the objects, a scroll compressor according to the present invention is the one airtightly covered in its entirety with an airtight container having a frame member, a fixed scroll member, a circling scroll member and driving means provided therein, the above described frame member being fixedly provided in the above described airtight container, the above described fixed scroll member being formed in a structure having an end plate, a pane extended from the above described end plate and a spiral scroll lap erected on the above described end plate and fixedly provided on the above described frame member, the above described circling scroll member being formed in a structure having an end plate, a pane extended from the above described end plate and a scroll lap erected on the above described end plate to form a compression space by engaging with the above described scroll lap of the above described fixed scroll member while being connected to the above described driving means and provided to be located between the above described frame member and the above described fixed scroll member, and the above described driving means driving the above described circling scroll member in a whirl to change capacity of the above described compression space and thereby compress the fluid, wherein a movable auxiliary member is provided by mounting it on the above described frame member between the above described frame member and the above described circling scroll member, and the above described movable auxiliary member has a stopper portion for causing a contact plane to contact the above described pane of the above described fixed scroll member and a ring portion having an opposed plane annularly formed to face the above described pane of the above described circling scroll member, is further supported elastically by elastic support means in a state of being energized in a direction of the above described circling scroll member, has the contact plane of the above described stopper portion caused to contact the above described pane in this elastic support state to keep a limit position with the above described opposed plane facing the above described pane of the above described circling scroll member, and goes back elastically to the above described frame member side when the above described circling scroll member goes back to the above described frame member side and the pane of the above described circling scroll member is pressed to contact the above described opposed plane.

According to the present invention, the scroll compressor is the one wherein the above described stopper portion is provided in a state of discretely projecting from the above described ring portion at multiple locations in an axial direction and in a state of projecting radially outside from a peripheral plane of the above described ring portion so that its internal plane slants radially outside against an inner peripheral plane of the above described ring portion.

According to the present invention, the scroll compressor is the one wherein the above described movable auxiliary member is provided to form a minute clearance with the above described opposed plane and the pane of the above described circling scroll member at the above described limit position.

According to the present invention, the scroll compressor is the one wherein the above described movable auxiliary member is provided to have the above described opposed plane contacted by the pane of the above described circling scroll member at the above described limit position.

According to the present invention, the scroll compressor is the one wherein, in the case where a conformance layer is provided to one or both of the above described fixed scroll member and the above described circling scroll member, the above described movable auxiliary member causes the above described opposed plane thereof to be in contact with the pane of the above described circling scroll member at the above described limit position until the above described conformance layer galls due to circling movement of the above described circling scroll member.

According to the present invention, the scroll compressor is the one wherein the elastic support means of the above described movable auxiliary member is formed by using a high-pressure fluid generated in the above described compression space.

According to the present invention, the movable auxiliary member is provided so as to configure an opposed plane setup structure therewith. According to the present invention, even if the circling scroll member goes back due to abnormal rise in compression space pressure or the like and the pane thereof is pressed to contact the opposed plane of the movable auxiliary member in the opposed plane setup structure, it is possible, for this reason, to avoid the state in which the movable auxiliary member goes back due to that pressure and the pane is strongly pressed to contact the opposed plane so as to effectively prevent occurrence of galling between the pane and the opposed plane and enhance reliability.

According to the present invention, the stopper portion is provided in the state of discretely projecting from the ring portion and in the state of projecting from the peripheral plane of the ring portion to the radial outside so that the internal plane thereof slants radially outside against the inner peripheral plane of the ring portion. Therefore, the respective internal planes of multiple stopper portions are placed along a circle of a diameter larger than that of the inner peripheral plane of the ring portion. For this reason, it is not necessary to enlarge a radial size of the frame member when securing a circling movement space of the circling scroll member in the state of having the movable auxiliary member mounted on the frame member. Consequently, it is possible to mount the movable auxiliary member on the frame member without changing a basic design of the frame member of an existing scroll compressor.

Other objects, features and advantages of the invention will become apparent from the following description of the embodiments of the invention taken in conjunction with the accompanying drawings.

DETAIL DESCRIPTION OF THE INVENTION

Figure 1:
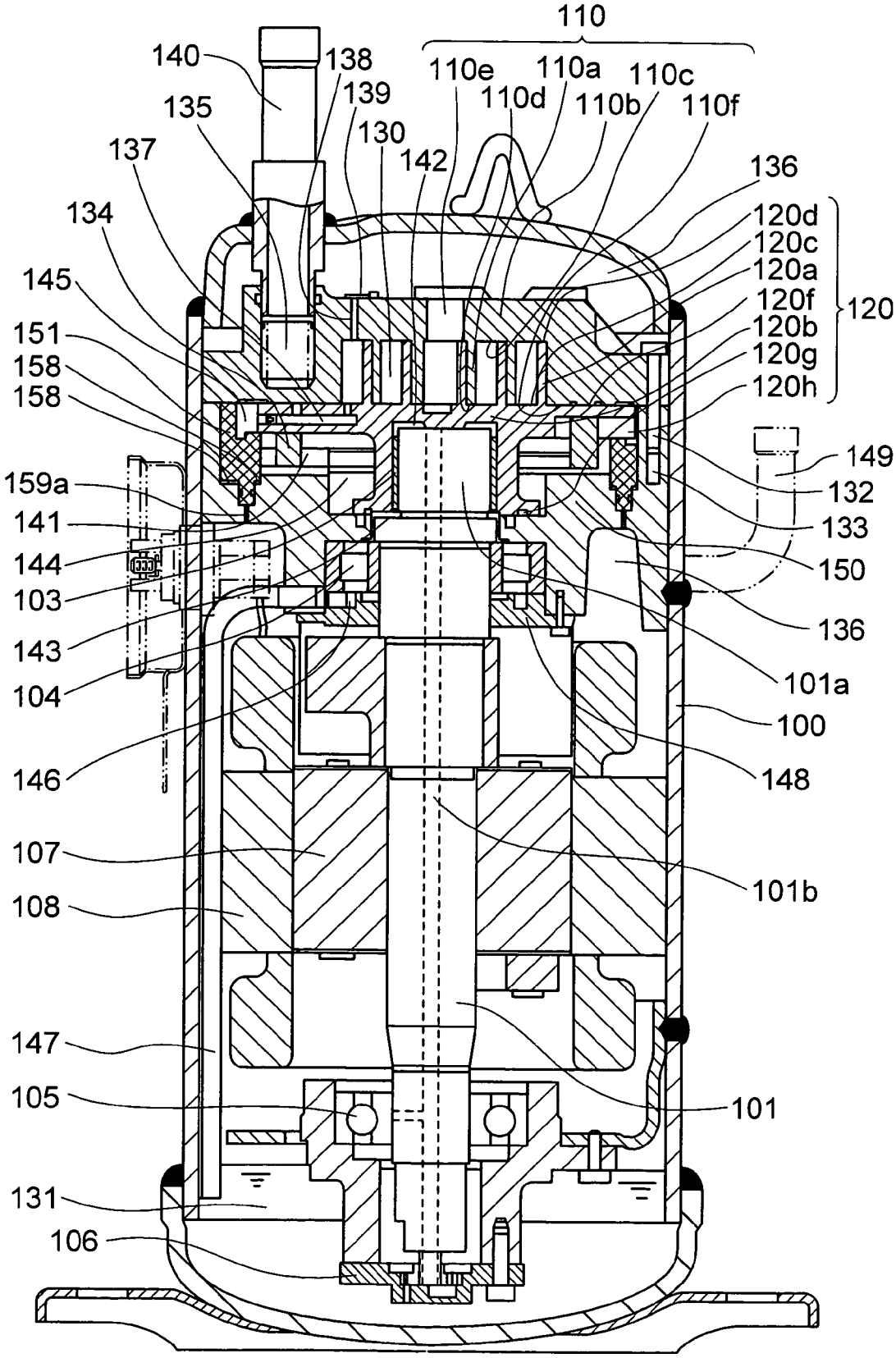
FIG. 1 is a diagram showing an overall internal structure of a scroll compressor according to a first embodiment.

Hereunder, preferred embodiments for implementing the present invention will be described. FIG. 1 shows an overall internal structure of a scroll compressor according to a first embodiment. The scroll compressor is airtightly covered in its entirety with a cylindrical airtight container 100 having its top and bottom sealed off as its basic structure. The airtight container 100 has a compression portion and a driving portion provided therein.

The compression portion is formed by combining a fixed scroll member 110 and a circling scroll member 120. The fixed scroll member 110 is formed in a structure having a spiral scroll lap 110*a* erected from a disciform end plate 110*b*, where the lap 110*a* has a lap tooth bottom 110*c* and a lap tooth top 110*d*. The fixed scroll member 110 has a discharge opening 110*e* provided at its center, and the end plate 110*b* has a pane 110*f* extended around it. The fixed scroll member 110 is fixed on a frame member 150 provided fixedly on an internal plane of the airtight container 100. It is usually fixed by fitting a fixing bolt 132 put through the fixed scroll member 110 into a screw hole 133 formed in the frame member 150 as in an example of FIG. 1. Though not shown in FIG. 1, the fixing bolts 132 are placed at multiple locations.

The circling scroll member 120 is formed in the structure having a spiral scroll lap 120*a* erected from a disciform end plate 120*b* as with the fixed scroll member 110, where that lap 120*a* has a lap tooth bottom 120*c* and a lap tooth top 120*d*. The end plate 120*b* has a pane 120*f* extended around it. The circling scroll member 120 has a connection portion 103 erected from the end plate 120*b* in an opposite direction to the lap 120*a*, and is connected via the connection portion 103 to an eccentric pin portion 101*a* of a crankshaft 101 of a driving portion described later. The circling scroll member 120 is combined with the fixed scroll member 110 so that the spiral scroll lap 120*a* thereof is engaged with the spiral scroll lap 110*a* of the fixed scroll member 110 in the state of putting their respective lap tooth top 120*d* and lap tooth top

110*d* in sliding contact with their respective lap tooth bottom 120*c* and lap tooth bottom 110*c* and the pane 120*f* thereof is put in sliding contact with the pane 110*f* of the fixed scroll member 110. Multiple compression spaces 130 are formed in this state of combination. Capacity of the compression spaces 130 changes due to circling movement of the circling scroll member 120 so as to compress a fluid.

The driving portion is driving means for driving the circling scroll member 120 in a whirl, and its structure using an electric motor is shown in the example of FIG. 1. To be more precise, the crankshaft 101 is connected to a rotor 107 of the electric motor consisting of the rotor 107 and a stator 108, where the crankshaft 101 is supported by roller bearings 104 and 105. The eccentric pin portion 101*a* is provided at an end of the crankshaft 101, and the circling scroll member 120 is connected to the eccentric pin portion 101*a* via the connection portion 103 to be movable in an axial direction. Therefore, the circling scroll member 120 moves in a whirl by receiving a circling force from the crankshaft 101 in an axially movable state.

It is necessary to prevent rotation of the circling scroll member 120, and an Oldham's ring 134 is provided for that purpose. The Oldham's ring 134 is formed in a structure having two mutually orthogonal sets of key-like projections. A set of the key-like projections are slid in a sliding groove 141*a* (FIG. 6) sandwiched by Oldham's ring acceptance planes 141 formed on the frame 150, and the remaining set of them are slid in a acceptance groove (120*h*) formed in a backside of an end plate material 120*b* of the circling scroll member 120 to be placed in a peripheral space formed being surrounded by the circling scroll member 120, frame member 150 and fixed scroll member 110.

A lubricant is supplied as to circling drive of the circling scroll member 120 by the driving portion and rotational movement of the crankshaft 101. That lubrication is performed by pumping up the lubricant stored in an oil reservoir 131 at the bottom of the airtight container 100 with a lubrication pump 106 and supplying it to necessary parts. To be more precise, a lubrication route 101*b* is provided inside the crankshaft 101. The lubricant pumped up by the lubrication pump 106 passes the lubrication route 101*b* and reaches a first central space 142 at the top of the eccentric pin portion 101*a*. Thereafter, it lubricates the connection portion 103 and then flows out into a second central space 143 on a side of the eccentric pin portion 101*a*. A minute amount of the lubricant having flowed out into the second central space 143 is supplied to a first peripheral space 144 by a seal portion provided on a circling scroll axis support portion end face 120*g*. However, a major part of it passes through the roller bearing 104 and returns to the oil reservoir 131 by way of a drainage route 146 and a drainage pipe 147 provided on a top face of a bearing cap 148. Here, it is also possible, instead of providing the lubrication pump 106, to pump up the lubricant by a centrifugal pump action utilizing the inside of the crankshaft 101. It is also possible, after supplying the major part of the lubricant having flowed out into the second central space 143 to the first peripheral space 144, to mix it with a fluid to be compressed (a refrigerant for instance) at the compression space 130 and discharge this compressed fluid mixed with the lubricant from the discharge opening 110*e* of the fixed scroll member 110 so as to separate the lubricant in the airtight container 100 and return it to the oil reservoir 131 thereafter. In the case of this configuration, it is also possible to use a differential pressure lubrication action utilizing a differential pressure between a discharge space 136 and the first peripheral space 144 or second peripheral space 145.

There are a suction stroke, a compression stroke and a discharge stroke, if roughly divided, in compression operation of the fluid by the circling movement of the circling scroll member 120. In the suction stroke, a working fluid is sucked into the compression space 130 by way of a suction opening 140 and a suction space 135 in conjunction with the circling movement of the circling scroll member 120. In the compression stroke, the capacity of the compression space 130 is reduced by the circling movement of the circling scroll member 120 so as to implement a compression action. In the discharge stroke, the working fluid compressed in the compression stroke is discharged into the discharge space 136 from the discharge opening 110*e* of the fixed scroll member 110, and is further discharged outside by way of a discharge opening 149. The compression space 130 has overcompression prevention means for preventing overcompression arising in operation at a pressure ratio lower than a design pressure ratio. In the example of FIG. 1, the overcompression prevention means is composed of a passage 138 and a valve 139.

In the strokes of such compression operation, and in the compression stroke in particular, it is necessary to secure sufficient airtightness to avoid causing a leak of the working fluid as much as possible between the suction space 135 and the compression space 130, between the compression spaces in different pressure states and between the compression space 130 and the discharge opening 110*e*. An elastic pressurization support structure for pressing the circling scroll member 120 to the fixed scroll member 110 is used for the sake of securing the airtightness. The elastic pressurization support structure consists of double elastic pressurization. One of the double elastic pressurization is configured to have approximately the same pressure as a discharge pressure of the working fluid both in the first central space 142 formed being surrounded by the end face of the eccentric pin portion 101*a* and the top face of the connection portion 103 and the second central space 143 formed being surrounded by the side of the eccentric pin portion 101*a* and the inner peripheral plane of the connection portion 103 and elastically press the center on the opposite side of the compression spaces of the end plate 120*b* of the circling scroll member 120 with the pressure of the fluid which is approximately the discharge pressure. The other of the double elastic pressurization is configured to have approximately an intermediate pressure lower than that in the first central space 142 and the second central space 143 both in the first peripheral space 144 formed being surrounded by the circling scroll member 120 and the frame member 150 and the second peripheral space 145 also formed being surrounded by the circling scroll member 120 and the frame member 150 and elastically press the pane 120*f* of the circling scroll member 120 with the pressure of the fluid of the intermediate pressure. According to this embodiment, the working fluid in the middle of compression is led to both the first peripheral space 144 and second peripheral space 145 via a small opening 137 communicating the spaces 144 and 145 to the compression space 130 in the middle of compression so as to generate the intermediate pressure of both the spaces 144 and 145. Such a configuration is just an example, and it is possible to use another configuration.

Figure 2:
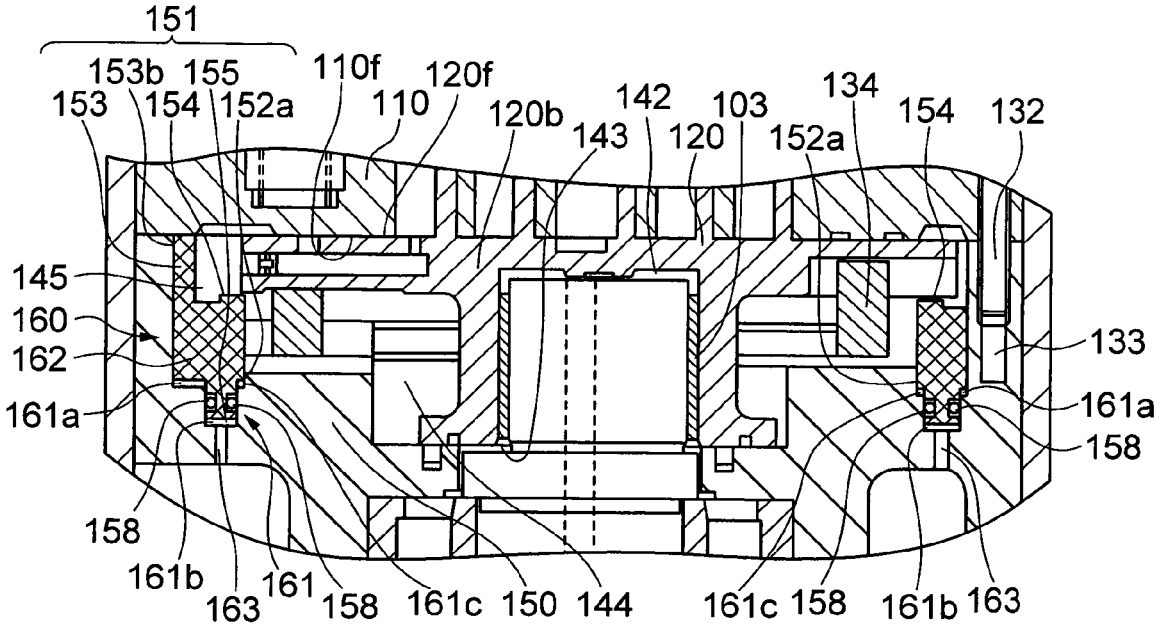
FIG. 2 is a diagram showing an enlarged view of a structure of a neighborhood of a movable auxiliary member according to the first embodiment.
Figure 3:
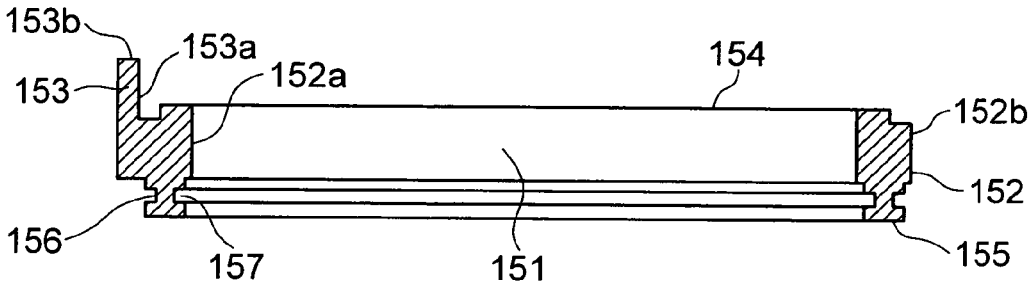
FIG. 3 is a sectional view of the structure of the movable auxiliary member according to the first embodiment.
Figure 4:
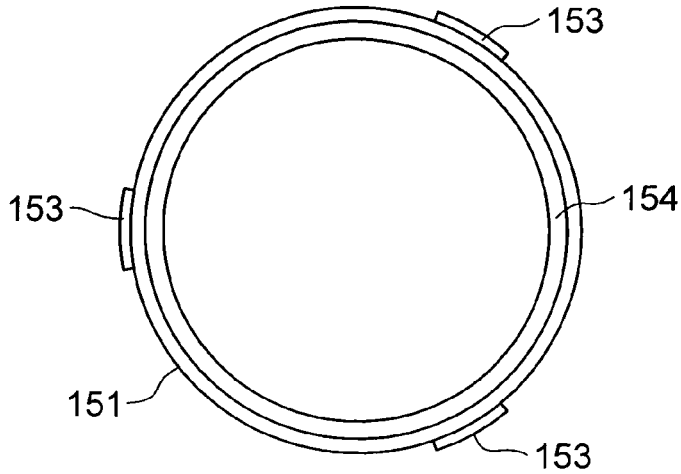
FIG. 4 is a diagram showing an overhead view of the structure of the movable auxiliary member according to the first embodiment.
Figure 5:
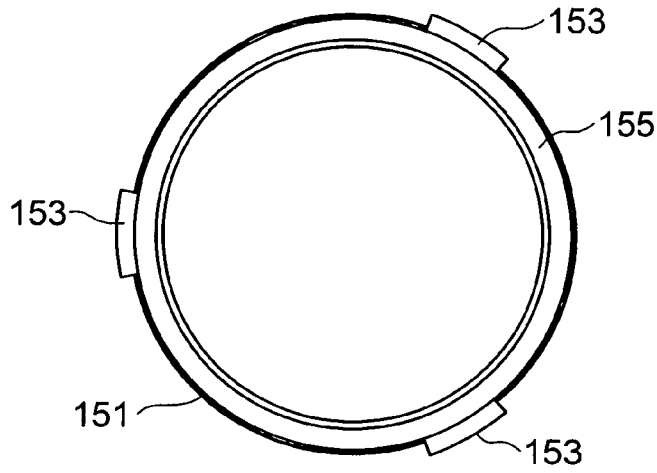
FIG. 5 is a diagram showing a worm's eye view of the structure of the movable auxiliary member according to the first embodiment.

The above described the basic structure of the scroll compressor. Hereunder, an opposed plane setup structure characterizing the present invention will be described. According to the present invention, the opposed plane setup structure is configured by mounting the movable auxiliary member 151 on the frame member 150. FIG. 2 shows a partially enlarged periphery of the movable auxiliary member 151, and FIGS. 3 to 5 show the structure of the movable auxiliary member 151. As shown in FIGS. 3 to 5, the movable auxiliary member 151 has a ring portion 152 and a stopper portion 153. The ring portion 152 is formed like a short cylinder, where an opposed plane 154 is annularly formed on one end face thereof and an elastic support acceptance plane 155 is annularly formed likewise on the other end face. The ring portion 152 has an outer seal portion 156 and an inner seal portion 157 formed at the end of the elastic support acceptance plane side so that a seal 158 such as an O ring, for instance, can be mounted on each of the seal portions as shown in FIG. 2.

The stoppers portion 153 is provided in the state in which it projects discretely from the ring portion 152 at multiple locations (three locations in the example of the drawings) in the axial direction, and its internal plane 153*a* slants radially outside against an inner peripheral plane 152*a* of the ring portion 152 and projects radially outside from a peripheral plane 152*b* of the ring portion 152 so that its apical surface becomes a contact face 153*b*.

Figure 6:
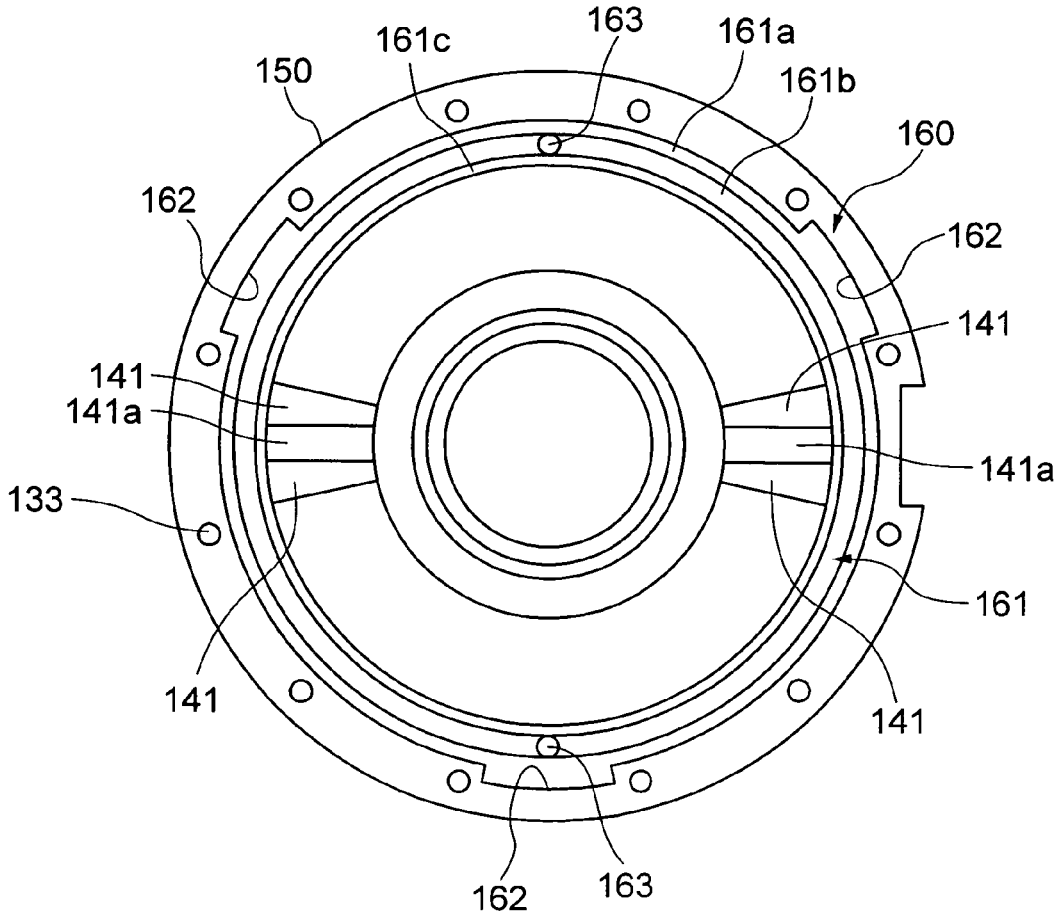
FIG. 6 is a diagram showing an overhead view of the structure of a frame member on which the movable auxiliary member according to the first embodiment is mounted.

The movable auxiliary member 151 thus formed is mounted on the frame member 150. For this reason, the frame member 150 has a mounting acceptance portion 160 provided thereon as shown in FIGS. 2 and 6. The mounting acceptance portion 160 consists of a ring portion acceptance portion 161 for accepting the ring portion 152 on the elastic support acceptance plane side thereof and a stopper portion acceptance portion 162 for accepting the stopper portion 153. The ring portion acceptance portion 161 is configured by forming a first annular groove 161*a*, a second annular groove 161*b* and a third annular groove 161*c* in tiers on the plane on the compression space side and the internal plane of the frame member 150 correspondingly to a cross-section on the elastic support acceptance plane side of the ring portion 152. The second annular groove 161*b* accepts the elastic support acceptance plane 155 of the ring portion 152 so as to form a back-pressure space for elastic support means by means of a high-pressure fluid. To be more specific, a high-pressure fluid passage 163 communicates in the bottom of the second annular groove 161*b*. The high-pressure fluid generated in the compression space 130 is led to the second annular groove 161*b* via the high-pressure fluid passage 163 so that the high-pressure fluid elastically presses and supports the ring portion 152. Regarding this, it is necessary to provide adequate airtightness to the back-pressure space, which is implemented by having the side of the second annular groove 161*b* contacted by the seals 158 mounted on the outer seal portion 156 and inner seal portion 157 respectively.

The stopper portion acceptance portion 162 is configured by forming on the internal plane of the frame member 150 a concave portion in a form corresponding to an outer shape of the stopper portion 153 projecting radially outside from the peripheral plane 152*b* of the ring portion 152.

If mounted on the frame member 150 by the mounting acceptance portion 160 described above, the movable auxiliary member 151 is elastically supported by the elastic support means of the high-pressure fluid to be energized in the direction of the circling scroll member 120 in the state movable to the axial direction. This energization by elastic support causes the contact face 153*b* of the stopper portion 153 to contact the pane 110*f* of the fixed scroll member 110 so as to keep a limit position (an upper limit position in the state of FIGS. 1 and 2). In the state of keeping the limit position, the movable auxiliary member 151 is put in the state, as shown in FIG. 2, in which the elastic support acceptance plane 155 of the ring portion 152 is slightly afloat from the bottoms of the annular grooves 161*a*, 161*b* and 161*c* and the opposed plane 154 of the ring portion 152 faces the pane 120*f* of the circling scroll member 120 with a minute clearance. The minute clearance should preferably be 10μ or less for instance, since the circling movement of the circling scroll member 120 can be performed more stably by providing such a minute clearance between the opposed plane 154 and the pane 120*f*.

The movable auxiliary member 151 keeps the above state in the state in which the compression operation is ordinarily performed by the compression portion. However, the circling scroll member 120, which is elastically pressed to the direction of the fixed scroll member 110 by utilizing the pressure of the fluid, goes back to the movable auxiliary member 151 side in the case where a force exceeding elastic pressure is exerted due to abnormal rise in the pressure of the compression space 130. If it thus goes back and the pane 120*f* is pressed to contact the opposed plane 154, the movable auxiliary member 151 accordingly goes back to the frame member 150 side until the elastic support acceptance plane 155 or another plane contacts the bottom of any one of the first to third annular grooves 161*a*, 161*b* and 161*c*. Thus it is possible, as the movable auxiliary member 151 goes back, to effectively prevent the pane 120*f* from being strongly pressed to contact the opposed plane 154 and causing a gall.

According to the present invention, the movable auxiliary member 151 as described above is provided so as to configure the opposed plane setup structure with the movable auxiliary member 151. Consequently, the following effects can be obtained. First, even if the circling scroll member 120 goes back due to abnormal rise in the pressure of the compression space 130 and the pane 120*f* thereof is pressed to contact the opposed plane 154 in the opposed plane setup structure, it is possible, as the movable auxiliary member 151 goes back due to that pressure, to avoid the state in which the pane 120*f* is strongly pressed to contact the opposed plane 154 so as to effectively prevent occurrence of galling between the pane 120*f* and the opposed plane 154 and enhance reliability.

Furthermore, it is possible to realize the opposed plane setup structure without increasing the diameter or size of the frame member. To be more specific, according to the present invention, the stopper portion 153 for defining a relation between the opposed plane 154 and the pane 120*f* is formed so that it should project discretely from the ring portion 152 in the axial direction and its internal plane 153*a* should slant radially outside against the inner peripheral plane 152*a* of the ring portion 152 and project radially outside from the peripheral plane 152*b* of the ring portion 152. Consequently, the respective internal planes 153*a* of the multiple stopper portions 153 are placed along a circle of a diameter larger than that of the inner peripheral plane 152*a* of the ring portion 152. To be more specific, it is possible to render the diameter of a virtual circle for connecting the respective internal planes 153*a* of the multiple stopper portions 153 larger than the diameter of the inner peripheral plane 152*a* of the ring portion 152. For this reason, it is not necessary to enlarge a radial size of the frame member 150 when securing a circling movement space of the circling scroll member 120 in the state of having the movable auxiliary member 151 mounted on the frame member 150.

To be more precise, it can be described as follows. As described above, the frame member 150 has the fixed scroll member 110 fixed with the fixing bolt 132 thereon, and so it is necessary to form the screw hole 133 on the frame member 150. Therefore, the side of the frame member 150 should have at least a predetermined thickness as to the portion forming the screw hole 133. This thickness is kept to the minimum necessary as a basis of the design for the reason of reducing the diameter size of the scroll compressor as much as possible. For the same reason, the diameter size of the internal plane of the frame member 150 is also kept to the minimum necessary to secure the circling movement space of the circling scroll member 120. Therefore, if the "movable auxiliary member" is to be mounted on the frame member 150 without changing the design of the existing scroll compressor, there arises a problem that the thickness necessary for the portion forming the screw hole 133 cannot be secured and so it is necessary to increase the diameter size of the frame member 150. However, it is possible, as with the present invention, to secure the circling movement space of the circling scroll member 120 by having the configuration in which the stopper portions 153 slant radially outside against the inner peripheral plane 152*a* of the ring portion 152, and it is also possible to provide the stopper portions 153 discretely so as to form the stopper portion acceptance portions 162 by avoiding the portions forming the screw holes 133 as shown in FIG. 6. Therefore, it thereby becomes feasible to mount the movable auxiliary member 151 on the frame member 150 without increasing the diameter size of the frame member 150 and avoid the problem. Thus, it becomes possible to avoid a problem of a significant cost increase due to design change work and procurement of a new mold in the case of changing the diameter size of the frame member 150.

According to this embodiment, the stopper portion 153 is integrally provided with the ring portion 152. It is also possible, however, to firmly fix the stopper portion formed as a separate member to the ring portion. According to this embodiment, the stopper portion acceptance portions 162 is formed as the concave portion on the internal plane of the frame member 150 so as to set the stopper portion 153 therein. Consequently, the stopper portion 153 also plays a role of preventing the rotation of the movable auxiliary member 151. It is also possible, however, to provide other means for preventing the rotation of the movable auxiliary member 151. According to this embodiment, inclination of the stopper portion 153 is controllable by guiding the inner peripheral plane 152*a* of the ring portion 152 of the movable auxiliary member 151 with the third annular groove 161*c* as shown in FIG. 2. However, this is not essential, and it is also feasible to omit the guide by the annular groove 161*c* and thereby further smooth the movement of the movable auxiliary member 151 in the axial direction. To further smooth the movement of the movable auxiliary member 151 in the axial direction, it is also possible to adopt a configuration in which the first annular groove 161*a* and third annular groove 161*c* communicate with the first peripheral space 144 and second peripheral space 145. That communication can be configured by forming a passage for communication inside the movable auxiliary member 151 or notching a part of the periphery of the movable auxiliary member 151. The above described that the minute clearance is formed between the opposed plane 154 and the pane 120*f* in an ordinary state. In the case where a conformance layer is formed on the fixed scroll member 110 or the circling scroll member 120 so that the conformance layer galls in an early operation stage and both the scroll members conform to each other, however, the opposed plane 154 may be in contact with the pane 120*f* until the conformance layer galls.

Hereunder, other preferred embodiments of the present invention will be described. The embodiments are basically the same as the first embodiment except the movable auxiliary member and the portions related thereto. Therefore, the following description of the embodiments will mainly describe components different from the first embodiment, and the components common with the first embodiment will be given common symbols so as to be assisted by the above descriptions.

Figure 7:
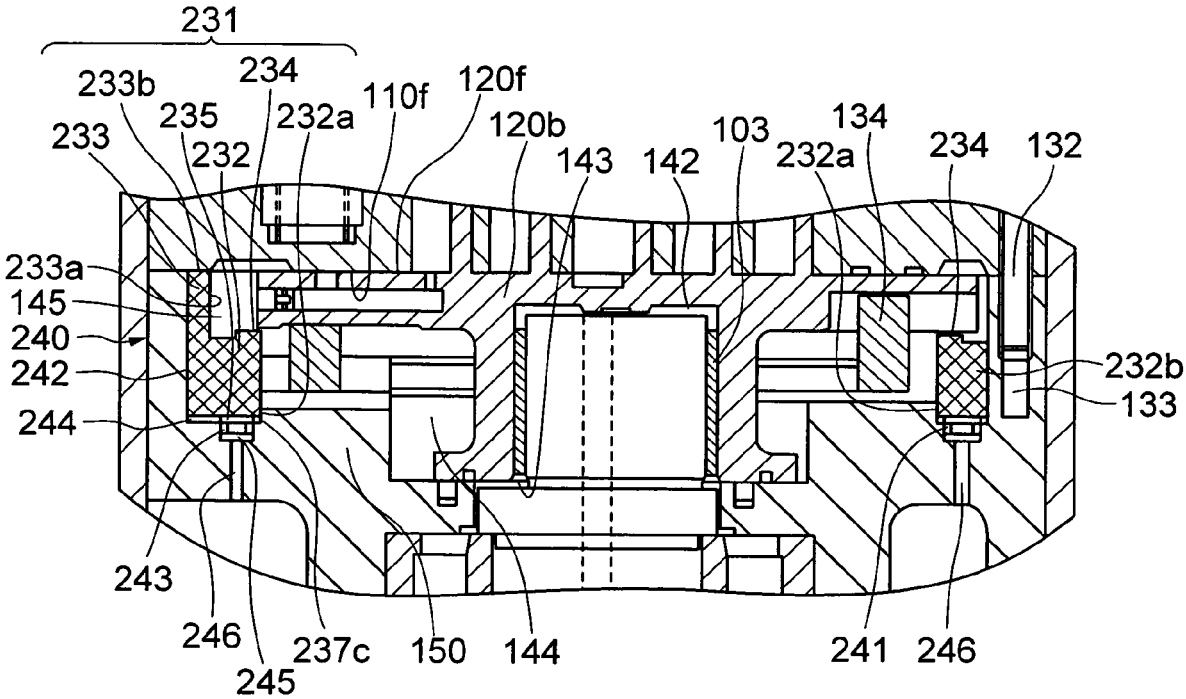
FIG. 7 is an enlarged view of the structure of the neighborhood of the movable auxiliary member of the scroll compressor according to a second embodiment.

FIG. 7 shows the configuration related to the movable auxiliary member of the scroll compressor according to a second embodiment. A movable auxiliary member 231 of this embodiment has a ring portion 232 and a stopper portion 233. The ring portion 232 has a configuration of the first embodiment, omitting the outer seal portion 156 and inner seal portion 157 provided to the ring portion 152 of the movable auxiliary member 151. To be more specific, the ring portion 232 is formed like a short cylinder, where an opposed plane 234 is annularly formed on one end face thereof and an elastic support acceptance plane 235 is annularly formed likewise on the other end face. The stoppers portion 233 is provided in the state in which it projects discretely from the ring portion 232 at multiple locations in the axial direction as with the stoppers portion 153 of the first embodiment, and its internal plane 233*a* slants radially outside against an inner peripheral plane 232*a* of the ring portion 232 and projects radially outside from a peripheral plane 232*b* of the ring portion 232 so that its apical surface becomes a contact face 233*b*.

A mounting acceptance portion 240 is provided on the frame member 150 correspondingly to such a configuration of the movable auxiliary member 231. The mounting acceptance portion 240 consists of a ring portion acceptance portion 241 for accepting the ring portion 232 and a stopper portion acceptance portion 242 for accepting the stopper portion 233. The ring portion acceptance portion 241 is configured to be able to implement a seal function omitted in the movable auxiliary member 231. To be more specific, the ring portion acceptance portion 241 is configured by forming an annular groove on the plane on the compression space side of the frame member 150 and further forming an annular groove 243 for a back-pressure space in the bottom of the annular groove. The annular groove 243 has a seal 244 mounted thereon. The mounting of the seal 244 causes a back-pressure space 245 for elastic support means of a high-pressure fluid to be formed in the bottom of the annular groove 243, and a high-pressure fluid passage 246 communicates with the back-pressure space 245. The stopper portion acceptance portion 242 is the same as the stopper portion acceptance portion 162 of the first embodiment. This embodiment described above has an advantage that the structure of the movable auxiliary member 231 can be further simplified.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll compressor airtightly covered in its entirety with an airtight container having a frame member, a fixed scroll member, a circling scroll member and driving means provided therein, the frame member being fixedly provided in the airtight container, the fixed scroll member being formed in a structure having an end plate, a pane extended from the end plate and a spiral scroll lap erected on the end plate and fixedly provided on the frame member, the circling scroll member being formed in a structure having an end plate, a pane extended from the end plate and a scroll lap erected on the end plate to form a compression space by engaging with the scroll lap of the fixed scroll member while being connected to the driving means and provided to be located between the frame member and the fixed scroll member, and the driving means driving the circling scroll member in a whirl to change capacity of the compression space and thereby compress the fluid, wherein a movable auxiliary member is provided by mounting it on the frame member between the frame member and the circling scroll member, and the movable auxiliary member has a stopper portion for causing a contact plane to contact the pane of the fixed scroll member and a ring portion having an opposed plane annularly formed to face the pane of the circling scroll member, is further supported elastically by elastic support means in a state of being energized in a direction of the circling scroll member, has the contact plane of the stopper portion caused to contact the pane in this elastic support state to keep a limit position with the opposed plane facing the pane of the circling scroll member, and goes back elastically to the frame member side when the circling scroll member goes back to the frame member side and the pane of the circling scroll member is pressed to contact the opposed plane.

2. The scroll compressor according to claim 1, wherein the stopper portion is provided in a state of discretely projecting from the ring portion at multiple locations in an axial direction and in a state of projecting radially outside from a peripheral plane of the ring portion so that its internal plane slants radially outside against an inner peripheral plane of the ring portion.

3. The scroll compressor according to claim 1, wherein the movable auxiliary member is provided to form a minute clearance to the opposed plane and the pane of the circling scroll member at the limit position.

4. The scroll compressor according to claim 1, wherein the movable auxiliary member is provided to have the opposed plane contacted by the pane of the circling scroll member at the limit position.

5. The scroll compressor according to claim 1, wherein a conformance layer is provided to one or both of the fixed scroll member and the circling scroll member, and the movable auxiliary member causes the opposed plane thereof to be in contact with the pane of the circling scroll member at the limit position until the conformance layer galls due to circling movement of the circling scroll member.

6. The scroll compressor according to claim 1, wherein the elastic support means of the movable auxiliary member is formed by using a high-pressure fluid generated in the compression space.

* * * * *